United States Patent [19]

Bobak

[11] Patent Number: 4,760,613

[45] Date of Patent: Aug. 2, 1988

[54] HYGIENIC TOILET SEAT ASSEMBLY

[75] Inventor: Tadeusz Bobak, San Francisco, Calif.

[73] Assignee: Incorema, San Francisco, Calif.

[21] Appl. No.: 140,406

[22] Filed: Jan. 4, 1988

[51] Int. Cl.[4] ..... A47K 13/19; A47K 13/20; A47K 13/22

[52] U.S. Cl. ..... 4/247; 4/243

[58] Field of Search ..... 4/247, 661, 242–246; 242/66

[56] References Cited

U.S. PATENT DOCUMENTS

| | | | |
|---|---|---|---|
| 1,037,062 | 8/1912 | Sayl | 4/247 |
| 2,189,562 | 2/1940 | Doerr | 4/247 X |
| 4,213,212 | 7/1980 | Hefty et al. | 4/247 X |
| 4,566,648 | 1/1985 | Hefty et al. | 4/242 X |
| 4,662,009 | 5/1987 | Hefty et al. | 4/242 X |

*Primary Examiner*—Henry K. Artis

*Attorney, Agent, or Firm*—Ostrolenk, Faber, Gerb & Soffen

[57] ABSTRACT

A hygienic toilet seat assembly where the toilet seat has the shape of a key ring with the overlapping placed at the rear region of the seat. A flat tubular protection cover is moved over the seat to protect it from being soiled and to protect the toilet user from contamination. Due to the overlapping configuration, the whole surface of the seat is covered by the protection tube. The seat can be lifted like conventional seats.

13 Claims, 2 Drawing Sheets

HYGIENIC TOILET SEAT ASSEMBLY

This invention belongs to the field of sanitary technics and particularly refers to a hygienic toilet seat mounted on a toilet bowl. The invention generally applies to water closets but is also applicable to dry closets.

The use of toilets, especially of public toilets, often not guarantees the necessary hygienic conditions. Seating on toilet seats may cause transmission of diseases, and basically, the aspect of a soiled toilet is disgusting and nauseous.

It has already been known to cover toilet seats with paper rings which are held available in some public or semi-public toilets, such as in restaurants. These paper rings do not remain fixed to the toilet seat in use, and they will block up the drain and sewage system should they fall into the toilet basin or be thrown therein.

U.S. patent specification No. 4,213,212 (Hefty) discloses an arrangement for fitting and changing a tubular cover made of plastic film on a toilet seat. The tubular cover is stored on a reel and pulled off from this reel as it is replaced, and the used cover is taken up on another reel. There are several disadvantages associated with this arrangement:

A. The plastic sleeve covers only the front portion of the seat. Therefore portions of the user's body may enter into contact with the unprotected, possibly contaminated toilet seat.

B. The take up reel acts as an incubator for bateria coming from the used surface of the sleeve, thus causing a health hazard and a bad odor. In one schematical drawing, a crossed cover path is suggested but there is no indication how this path can be put into practice; furthermore, even with that crossed path, the toilet seat is not completely covered since the location of crossing is outside the toilet seat.

It is now a first and principal object of the invention to provide an improved system for the protection of the total surface of toilet seats from being soiled, and for the protection of the toilet user from being contaminated by unclean toilet seats.

A further object of this invention is to provide a new and improved hygienic toilet system using a tubular, sleeve-like protection cover having mechanically uncomplicated and simple driving means.

Still another object of the invention is to fit the toilet seat with simple but effective friction and torsion reducing means for the tubular protection sleeve adapted to slide over the seat.

A further object of the invention is to have the toilet seat always entirely covered by the protection sleeve, and to avoid the accumulation of the used sleeve on a reel or spool.

These objects and still others are now met and implemented by the sanitary toilet seat assembly of the invention, comprising a toilet seat of split ring-shaped configuration such as a key ring, a protective sleeve adapted to slide as a tube over the toilet seat, and protective sleeve entrainment means. According to the invention, the toilet seat has the configuration of a closed loop with superimposed end portions. The superimposition is arranged at the rear region of the toilet seat. In this manner, an absolute complete covering of the toilet seat by the protective sleeve is accomplished.

The infeed direction of the continuous sleeve over the toilet seat is the same as that of the outgoing sleeve.

Thus, the sleeve, when moved, travels in parallel in the zone of superimposition of the straight toilet seat sections.

The ring section of the toilet seat is provided with antifrictional means to avoid the formation of creases and swellings of the protective sleeve when pulled along the ring section. Furthermore, the ring section of the toilet seat may be coated with an anti-frictional material such as nylon or teflon.

The invention will now become easier and more complete to be understood by the description of preferred embodiments thereof which is given by way of examples only; these examples are not construed to limit the invention to these embodiments.

Reference is made to the drawing wherein.

In the figures, identical or similar parts have the same reference numerals.

Figure 1:
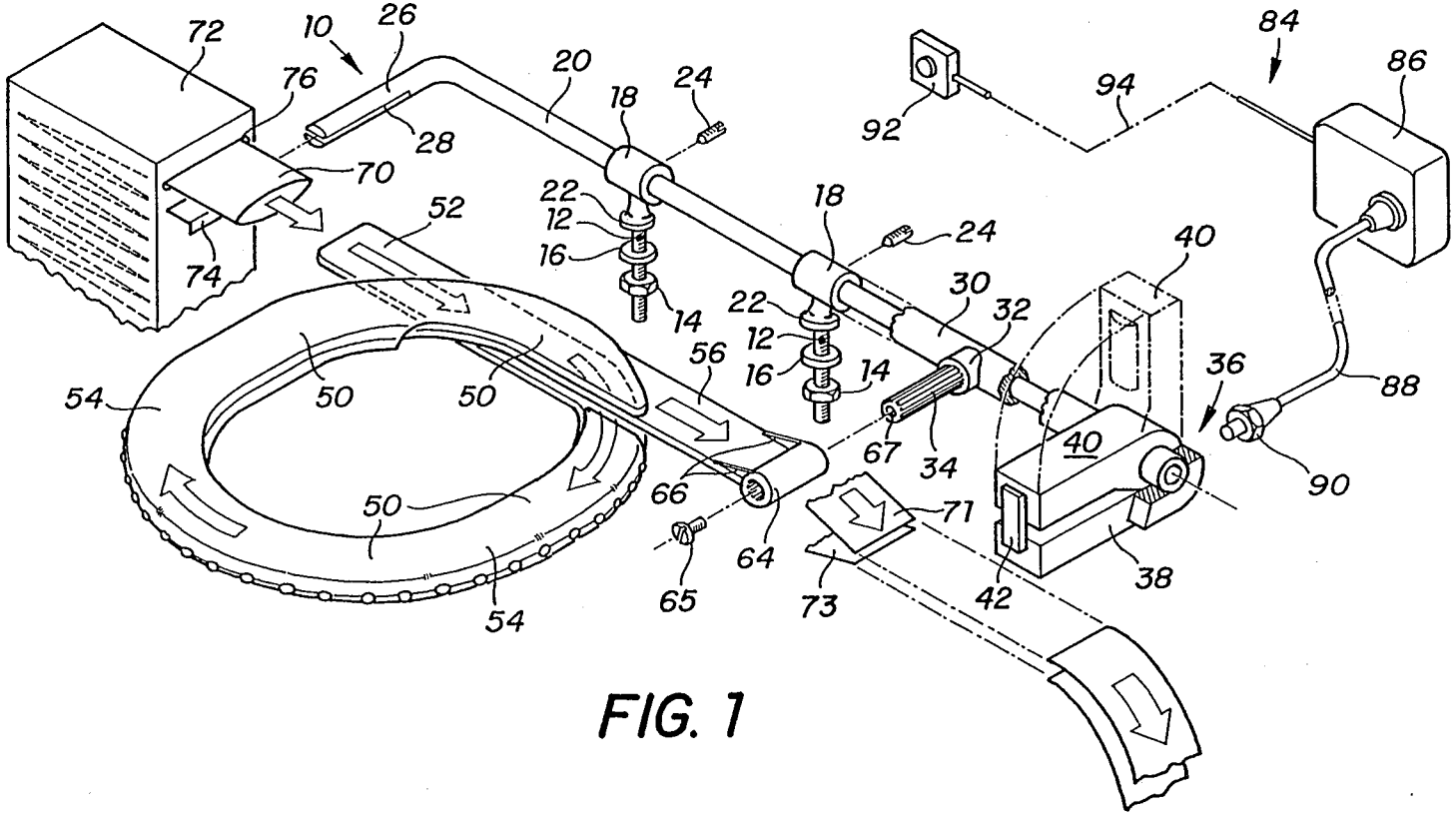
FIG. 1 is a perspective, exploded view of a toilet seat assembly according to the invention.

The toilet seat assembly shown in FIG. 1 is adapted to replace a known standard toilet seat. Standard toilet basins or bowls are generally made of ceramics such as porcelain; on their upper, horizontal surface, they are provided at the rear zone, directed to the toilet room wall, with two vertical borings or openings adapted to the fixation of bolts which hinge the toilet seat and the seat lid. This arrangement is conventional and well known to everybody and need not be shown in a drawing.

In the same way, the toilet seat assembly of the invention is adapted to be fixed to the toilet bowl by two vertical studs 12 which are part of an installation bar assembly generally designed by 10.

The fixation studs 12 have a vertical shaft threaded on the major partion of its length. Nuts 14 and washers 16 are provided which serve to secure the bar assembly 10 to the toilet bowl (not shown).

The studs 12 comprise a head 18 having a horizontal boring to receive the main bar 20, see FIG. 1. The lower portion of the head 18 is provided with a circular rim 22 whose lower surface is plane; the rim will come to rest on the toilet bowl when the assembly is installed. Of course, an elastic washer (not shown) made of plastic or elastic materials such as nylon or rubber may be inserted on the shaft 12, between the rim 22 and the toilet bowl, to prevent damaging of the ceramic material of the bowl.

The heads 18 of the studs 12 further comprise two threaded half-borings (not shown) whose axes are normal to that of the borings for the main bar 20. Worm screws 24 can be inserted from behind into the said half-borings to rigidly secure the main bar 20 in its desired position to the studs 12.

The left-hand end portion 26 (as seen in FIG. 1) of the main bar 20 is bent forwardly at an angle of 90°. This portion 26 is provided with a horizontal slot 28.

At the right-hand section, as seen in FIG. 1, the main bar bears a fixation device for the toilet seat. This fixation device is shown in more detail in FIG. 5.

The fixation device comprises a main tubular support 30. The inner diameter of the tube 30 corresponds to the outer diameter of the main bar 20 so that the tube 30 may be rotated with some play about the main bar 20. Tube 30 comprises, at about its mid portion, a reinforcement head 32 to which a ribbed stud 34 is secured. A drive assembly 36 is fixed to the right-hand free end portion of the tubular support 30. The drive assembly 36 comprises a lower drive part 38, secured to the tubular support 30, and an upper counterpart 40 which is rotatably journalled on the tubular support 30. A snap closure 42, when closed, holds the upper counterpart 40 tightened against the lower drive part 38, and when opened, allows to swing the counterpart on the tubular support 30, see the dotted line position in FIG. 1.

The drive part 38 comprises an horizontal drive roller (not shown) protruding into the free space between the two parts 38 and 40. The counterpart 40 comprises an horizontal free running pressure roller (not shown) to engage the drive roller when the drive assembly is closed. At least one of the said two rollers has a resilient surface. The drive roller is provided at its rear end with a female snap connection (not shown) for a flexible drive shaft.

The length of the tubular support 30 corresponds to that of the free right-hand portion of the main bar 20 taken from the right-hand head 18 to the bar end. The support 30 is slid over that portion of the main bar 20 and secured for horizontal displacement by the end screw 44 to be screwed into a threaded blind hole in the main bar 20 (see FIG. 5).

The toilet seat 50 (FIGS. 1 to 4) has the shape of an overlapping complete loop, the overlapping taking place at the rear region of the seat, seen as in FIG. 1. The seat has the conventional flat section and comprises generally a first straight portion 52 followed by the ring portion 54. This ring portion may be circular or oval, as convenient, or have any desired other shape. The ring portion 54 ends on the top of and in superimposed relationship to the first straight portion 52, and is followed by the second straight portion 56 which is aligned with the first straight portion 52. The beginning of the ring portion 54 coincides with its end, as it may best be seen in FIGS. 1 and 2, such as to form a nearly continuous seating surface.

Figure 2:
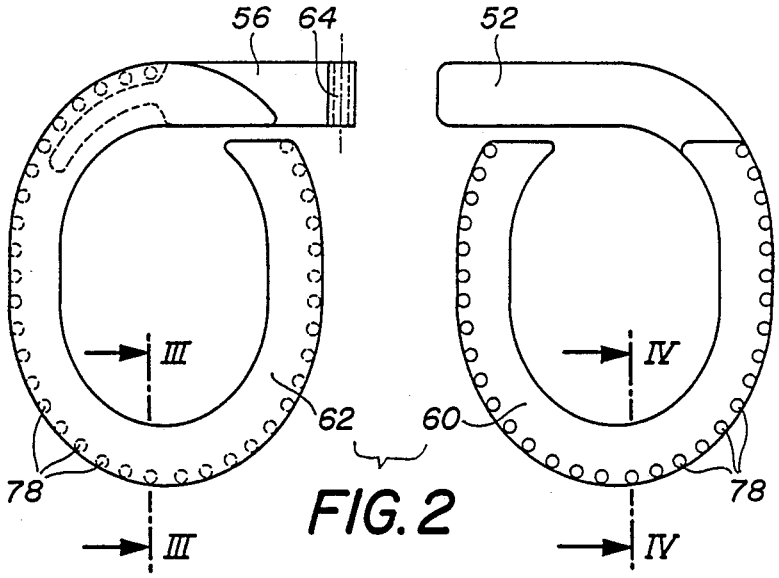
FIG. 2 is a top view of the toilet seat of FIG. 1, showing its structure.
Figure 3:
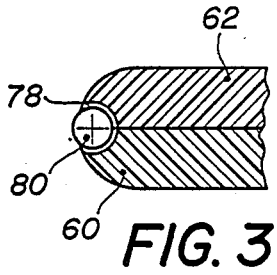
FIG. 3 is a partial sectional view in the plane indicated by line III—III in FIG. 2.
Figure 4:
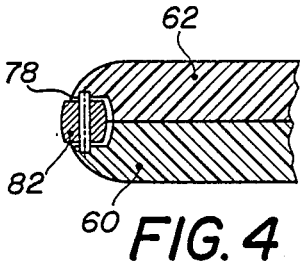
FIG. 4 is a partial sectional view in the plane indicated by line IV—IV in FIG. 2.

The general construction of the overlapping toilet seat is shown in FIG. 2. The seat is made up of two main parts, namely a lower part 60 and an upper part 62. These two parts are generally made of synthetic materials and are congruent along the major portion of the seat. They are joined together at their matching surfaces, see FIG. 3 and 4, by cementing or welding such as high frequency or ultrasonic welding. The end portion of the upper part 62 is joined by part insertion and molding with the seat support part 56 made preferably of a mechanically resistant material such as stainless steel. This seat support part 56 ends in a grooved bushing 64 cooperating with the above described ribbed stud 34 of the fixation bar assembly 10.

Figure 5:
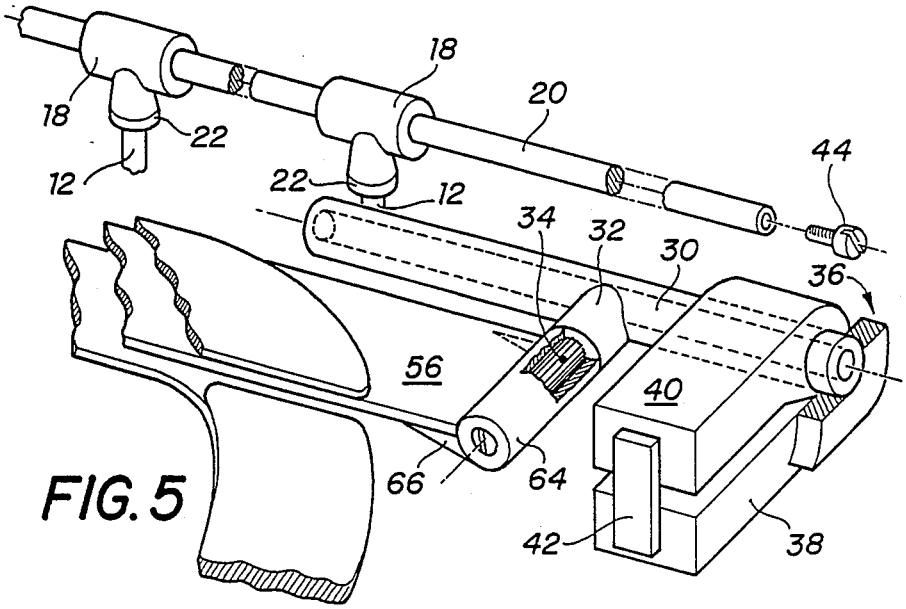
FIG. 5 is a perspective, partially broken-away view of a detail of FIG. 1.

Sharp blades 66 are provided at the borders of the straight portion 56 at the end and between the part 56 and the bushing 64. It is preferred to mount the blades 66 beneath the seat, as shown in FIG. 5.

The lower part 60 (FIG. 2) comprises the first straight portion 52 which is an extended arm molded to the ring portion 54. The free end of the straight portion 52 is rounded to facilitate the feed-in of the protective sleeve.

This protective sleeve 70, made of paper, reinforced paper, or synthetic materials, is fanfold stacked in a supply box 72 which has a fixation flap 74 at one of its small surfaces. The sleeve 70 is flattened and can be pulled out of the supply box 72 through a slot 76.

The outer circumference of the combined ring porting 54 is provided with a plurality of cavities 78 wherein free running balls 80 or roller 82 are lodged. These balls rollers will act as a kind of ball or roller bearing for the protective sleeve 70 as it travels along the toilet seat.

A drive assembly 84 comprises a drive box 86 housing an electric motor and metering means of the advance of the protective sleeve. These metering means may be based on time measurement or on revolution measurement of the drive roller in the drive part 38; the purpose of the metering means is to determine the advance of a predetermined length of the protective sleeve 70 over the seat 50. A flexible shaft 88, provided with a male snap connection 90, connects the drive motor (not shown) to the drive roller (not shown) in the fixed drive part 38. A push-button device 92 is connected via the line 94 to the drive box 86.

Now, the installation of the described toilet seat assembly and its operation will be described.

First, the main support bar is installed on the bare toilet bowl, after removal of the normal toilet seat if already installed. For this step, the worm screws 24 are loosened, the nuts 14 and washers 16 are removed from the studs 12, the studs are inserted into the two corresponding vertical holes of the toilet bowl, and the studs are secured to the bowl. Then, the support tube 30 is slid over the main bar 20, and the end screw 44 is screwed into its hole and tightened.

The seat 50 is now installed with its grooved bushing 64 on the ribbed stud 34 in a slightly angled position. The grooves in the bushing 64 and the ribs on the stud 34 cooperate as follows. When the toilet seat assembly is mounted, the seat supporting bushing 4 is mounted on the ribbed stud 34 in such a manner that the second straight portion 56 of the toilet seat will form a small positive angle with the horizontal plane. Thus, when there is no vertical pressure on the seat by a person using the toilet, i.e. when the seat is free, the seat assembly forms a helical ramp since the two straight portions 52 and 56 are not in contact. On use, the rear upper portion of the seat will contact the lower one by the inherent resilience of the steel part 56. The above described position of the bushing 64 on the stud 34 is fixed with the end screw 65 screwed and tightened in the threaded blind hole 67 of the ribbed stud 34.

The main bar 20 is now positioned in such a way that the toilet seat is centered over the opening of the toilet bowl. In this position, the support tube 30 has just a small horizontal play between the right-hand stud head 18 and the end screw 44. The bent portion 26 is to be positioned substantially horizontally. The worm screws 24 are tightened in this position of the main bar 20.

Finally, the flexible shaft 88 is snap fixed to the drive unit 36.

The protective sleeve may now be fitted to the toilet seat. This step is the only one to be performed during normal use of the system of this invention. The flap 74 of the supply box 72 is inserted into the slot 28 of the main bar 20, portion 26. The leading end of the protective sleeve 70 is introduced over the first straight portion 52 of the toilet seat 50, then pulled manually around the seat (ring portion 54, and then over the second straight portion 56) along the path indicated by the arrows, until it reaches the support bushing 64 where it is cut by the edges 66 into an upper strip 71 and a lower strip 73. The counterpart 40 of the drive unit 36 is raised in its position shown in dotted lines, after opening of the snap-lock 42, both strips 71, 73 are further pulled and placed together on the drive roller of the drive part 38. The drive assembly is now closed by lowering the counterpart 40 and closing the snap-lock 42 which takes place automatically. Now, the two rollers housed in the parts 38 and 40 of the drive unit 36 squeeze the two strips 71, 73 between them.

After these steps, the introduction of a new protective sleeve has been accomplished, and the hygienic toilet seat is now ready to perform its automatic operation cycles.

It should be added that the drive box 86 has previously been installed on the wall of the toilet room in the neighbourhood of the water tank of the toilet in such a way that the outlet of the flexible shaft 88 should be in the same plane, or below this plane, as the drive shaft in the unit 36. The push-button device 92 may be fixed at any appropriate location.

The system works as follows. On touching the start button of the control device 92, the motor in the drive box 86 is energized. The rotational force obtained from the motor housed in the drive box 86 is transmitted by means of the flexible shaft 98 to the drive roller in the drive unit 36. Since the protective sleeve 70 (or the two individual strips 71, 73) are squeezed between the drive roller and the friction roller, a fresh length of sleeve 70 will be pulled from the supply box 72 over the seat. An automatic revolution or time counting switch located in the drive box 86 will stop the drive motor when a predetermined, appropriate length of fresh protective sleeve has been pulled over the toilet seat to cover it entirely.

The protective sleeve stored in the supply box in fanfold stacks may be printed, e.g. with instructions for the user. It may also be impregnated with desinfectant or biocidal preparations, in order to still improve toilet hygienics, and impregnated with perfume compositions.

A collecting box or bag for used protective cover may be provided at the outlet of the drive unit 36. A cutter device to be operated manually for example, may also be provided at the outlet in order to improve the storage of used protective sleeve.

The drive box can be of various type of construction using electric sources, directly from the local mains network, from batteries, from storage accumulators, from photovoltaic devices, hydraulic devices, through power adaptors, etc.

It will be obvious to those skilled in the art that various changes and modifications may be made without departing from the scope of the invention, and the invention is not to be considered limited to what is shown in the drawings and described in the specification. As a further example of such changes, since the flushing system of the toilet has no function or connection with the toilet seat of this invention, the toilet seat protecting system may also be used in dry closets, such as in shelters.

Furthermore, the protective sleeve need not be arranged as a fanfold stack but may also be supplied from a roll.

In the protective sleeve drive means, one roller at least is actively driven by the drive motor. However, the other roll, namely the friction roll, may also be driven, for example by an appropriate toothed wheel gear.

Of course, the toilet seat of the invention may be provided, in a manner known per se, with a foldable seat cover lid.

What is claimed is:

1. A hygienic toilet seat assembly comprising a toilet seat of open overlapping split-ring shaped configuration, a protective sleeve adapted to slide as a tube over the said toilet seat, and protective sleeve entrainment means, wherein said toilet seat has the configuration of a closed loop with superimposed end portions at the rear region of said seat, thus providing a complete covering of the seat by said protective sleeve, the infeed sense of said protective sleeve into said seat having substantially the same direction as the outlet sense.

2. The toilet seat assembly of claim 1 wherein the infeed sense and the outlet sense of said protective cover are parallel but are vertically offset from each other.

3. The toilet seat assembly of claim 1 wherein the toilet seat comprises a first straight section for the infeed of said protective sleeve, followed by a ring section, and a second straight section for the outlet of said protective sleeve, said second straight section being parallel to the first straight section and in superimposed relationship thereto.

4. The toilet seat assembly of claim 3 wherein said first straight section comprises a flat piece of a mechanically resistant material rigidly joined to one end portion of said ring section, and said second straight section comprises a flat piece of a mechanically resistant material rigidly joined to the other end portion of said ring section, said ring section forming a nearly closed loop with the ring gap at the rear region of said seat.

5. The toilet seat assembly of claim 3 further comprising a fixation assembly adapted to pivotably connect said seat to a toilet bowl, said fixation assembly comprising a generally horizontal main bar provided with two toilet bowl fixation studs, and a tubular toilet seat fixation support arranged to fit over said main bar and rotatable about said bar, said fixation support further comprising a laterally protruding ribbed seat fixation stud and protective sleeve driving means.

6. The toilet seat assembly of claim 3 wherein said second straight seat section comprises a grooved bushing for the torsion-proof fixation of said seat to said tubular fixation support on said ribbed stud, said first straight section being provided in the neighbourhood of said bushing and at both borders thereof with cutting edges for the protective sleeve.

7. The toilet seat assembly of claim 5 wherein said main bar of said fixation assembly comprises a horizontally slotted end portion bent off by about 90° to the front of said main bar, said slot being adapted to receive a connection and holding flap of a protective cover supply box wherein fresh protective sleeve is contained as a fanfold stack of flattened sleeve.

8. The toilet seat assembly of claim 1 wherein said protective sleeve entrainment means comprises, fixed to said tubular fixation support at the free end position thereof, a drive assembly comprising a lower drive part wherein a drive roller is lodged, and a upwardly rotatable counterpart wherein a friction roller is lodged, said two parts of said drive assembly being adapted to cooperate in closed position to squeeze the protective sleeve between said two rollers and to advance it on rotation of said drive roller.

9. The toilet seat assembly of claim 8, further comprising a drive box containing an electric motor removably connected through a flexible shaft to said drive roller, and protective sleeve metering means for pulling a predetermined length of said protective sleeve along and over said toilet seat.

10. The toilet seat assembly of claim 3 wherein said ring section of the toilet seat is formed by two superimposed seat halves rigidly joined together.

11. The toilet seat assembly of claim 3 wherein said ring section of the toilet seat comprises at its outer circumferential portion a plurality of balls or rollers embedded into the seat material but slightly projecting above the circumferential surface, adapted to reduce the friction of said protective sleeve.

12. The toilet seat assembly of claim 5 wherein said second straight seat section comprises a grooved bushing for the torsion-proof fixation of said seat to said tubular fixation support on said ribbed stud, said first straight section being provided in the neighborhood of said bushing and at both borders thereof with cutting edges for the protective sleeve.

13. The toilet seat assembly of claim 5 and wherein said protective sleeve entrainment means comprises, fixed to said tubular fixation support at the free end position thereof, a drive assembly comprising a lower drive part wherein a drive roller is lodged, and an upwardly rotatable counterpart wherein a friction roller is lodged, said two parts of said drive assembly being adapted to cooperate in closed position to squeeze the protective sleeve between said two rollers and to advance it on rotation of said drive roller.

* * * * *